US006036806A

United States Patent [19]

Dahlquist

[11] Patent Number: 6,036,806

[45] Date of Patent: Mar. 14, 2000

[54] POP-UP ADVERTISING DEVICE AND METHOD

[75] Inventor: Ake L. Dahlquist, Dixon, Ill.

[73] Assignee: Sleepeck Printing Company, Dixon, Ill.

[21] Appl. No.: 09/113,262

[22] Filed: Jul. 10, 1998

Related U.S. Application Data

[62] Division of application No. 08/589,988, Jan. 23, 1996, Pat. No. 5,813,596.

[51] Int. Cl.[7] ..... B31F 53/06

[52] U.S. Cl. ..... 156/227

[58] Field of Search ..... 156/442.1, 204, 156/227, 226; 229/92, 92.1, 92.7; 40/124.06, 124.08, 124.11, 124.12, 124.09

[56] References Cited

U.S. PATENT DOCUMENTS

| | | | |
|---|---|---|---|
| 1,208,179 | 12/1916 | McClay et al. . | |
| 1,340,114 | 5/1920 | Brandt . | |
| 1,467,148 | 9/1923 | Farkas | 229/92.1 |
| 1,509,662 | 9/1924 | Barnett . | |
| 2,016,063 | 10/1935 | White | 229/92.5 |
| 2,074,821 | 3/1937 | Wissmann | 229/92.1 |
| 2,125,268 | 8/1938 | Boyer | 40/124.08 |
| 2,131,448 | 9/1938 | Lowen | 40/125 |
| 2,148,279 | 2/1939 | Sandberg | 40/124.08 |
| 2,983,431 | 5/1961 | Turan | 229/92.3 |
| 3,061,173 | 10/1962 | Sawdon | 229/73 |
| 3,288,350 | 11/1966 | Kushner | 229/70 |
| 3,863,836 | 2/1975 | Austin | 229/73 |
| 3,982,689 | 9/1976 | Retrum | 229/71 |
| 3,995,388 | 12/1976 | Penick et la. | 40/126 |
| 4,337,589 | 7/1982 | Volkert et al. | 40/124.1 |
| 4,592,573 | 6/1986 | Crowell | 40/124.08 |
| 4,731,048 | 3/1988 | Marella et al. | 229/92.8 |
| 4,865,247 | 9/1989 | Grabner | 229/92.1 |
| 5,161,735 | 11/1992 | Bendel | 229/303 |
| 5,174,493 | 12/1992 | File | 229/301 |
| 5,346,455 | 9/1994 | Volkert | 493/335 |

*Primary Examiner*—Michael W. Ball
*Assistant Examiner*—Gladys Piazza
*Attorney, Agent, or Firm*—Ryndak & Lyerla

[57] ABSTRACT

A printed advertising device is formed by folding a sheet to enclose a pop-up insert. The pop-up insert is a folded sheet that is initially retained within the advertising device by a novel arrangement, but "pops-up" when the advertising device is accessed to gain the attention of the person opening the device. The advertising device is created by several manipulations of a web, such as folding and applying adhesive using web printing equipment. The advertising device may be a mailing device, a magazine insert or a stand-alone circular.

9 Claims, 6 Drawing Sheets

300
302
322
316
304
PULL
312
306
SAMPLE
310
16
314
330
340
332
336
326
328
320
306
334
302
324
C
312
B
402
220
400
220
404

400
402
214
404
220

400
402
210

404
400
402
404
206

POP-UP ADVERTISING DEVICE AND METHOD

This is a divisional of U.S. patent application Ser. No. 08/589,988, filed Jan. 23, 1996 now U.S. Pat. No. 5,813,596.

FIELD OF THE INVENTION

This invention relates to an advertising device and method for printed matter, and in particular, to an advertising device and method that includes a pop-up insert that through various aspects attracts the attention of consumers.

BACKGROUND OF THE INVENTION

The consuming public is inundated with print advertisement, such as mail, newspaper ads and magazine ads. This places advertisers in competition with each other to gain the attention of consumers. Prior attempts to gain the attention of consumers have included catchy slogans, startling artwork, novelty items, contests, prizes, redeemable coupons and in some cases even the inclusion of token sums of money. Though these traditional attempts at gaining the attention of consumers have been somewhat successful, a continuous need exists for a structure that gains the attention of consumers, to gain more sales per advertising dollar.

Additionally, attempts to gain the attention of consumers must be capable of reaching numerous consumers in an efficient manner. Thus, the most efficient attention grabbing advertisement should be easily mass manufactured and otherwise cost effective.

SUMMARY OF THE INVENTION

Accordingly, one aspect of the present invention provides an advertising device and method with novel structural features for gaining the attention of consumers.

In accordance with another aspect of the present invention, an advertising device and method are provided that may be manufactured using commercially available printing press and in-line finishing equipment.

In accordance with the principles of the present invention, an advertising device or vehicle, which may be in the form of a mailing device, a magazine insert or a stand-alone circular, is provided. The advertising device may be mass manufactured using available graphic arts web press equipment. The advertising device includes a novel insert device that pops up from the advertising device, attracting the attention of the person opening the device.

In one aspect of the present invention, an advertising device in the form of a mailing device is formed from a first sheet having a cover panel, a front panel and a spring panel. The cover panel adjoins the front panel at a first fold and the front panel adjoins the spring panel at a second fold. The cover, front and spring panels each have an inner surface and an outer surface. The front panel serves as the front of the mailing device wherein the address is displayed. The spring panel and cover panel jointly form the back of the mailing device, the intersection of the two providing a means for accessing the interior of the mailing device. A pop-up insert is retained within the mailing device. The pop-up insert has an attaching panel and a free panel. The attaching and free panels are adjoined at a third fold and have an inner surface and an outer surface. The outer surface of the attaching panel is attached to a portion of the inner surface of the cover panel. The free panel is oriented by the third fold such that its inner surface is adjacent the inner surface of the free panel. In a closed configuration, a free end of the spring panel opposite the first fold overlies the attaching panel near the third fold. A portion of the inner surface of the cover panel is adhesively attached near the free end of the cover panel to the outer surface of the spring panel near the free end of the spring panel.

In normal operation, the receiver of the mailing device will hold it near the second fold with his thumb and finger securing the spring panel in place. The cover panel is then lifted. Initially, the spring panel retains the insert within the mailing device, resisting the movement of the cover panel to which it is attached. Eventually, the person opening the mailing device will overcome the force retaining the insert, allowing the insert to escape the confines of the spring panel and "pop-up" to gain the attention of the person opening the device.

In another aspect of the present invention, the pop-up insert, in addition to the attaching panel, may have a plurality of free panels, adjacent ones of which are adjoined by a fold. Most preferably, the folds will vary in vertical relation to each other to provide multiple pop-ups in steps upon opening the mailing device.

In yet another aspect of the present invention, an enclosure is confined within the mailing device. The enclosure will preferably contain useful information and will most preferably include a return envelope and a response card or order form or pledge card for a donation. The enclosure may be adhesively attached to either the inner surface of the front panel or the inner surface of the cover panel. Where attached to the cover panel, the enclosure may add to and vary the pop-up effect.

In another aspect of the present invention, an advertising device in the form of a magazine insert is provided. The magazine insert is formed from a single sheet folded into two panels. At least one of the panels has an opening through which a pop-up insert is accessible. The insert is partially covered by the panels and the panels are adhesively joined in an area near the insert. A person may gain access to the insert through the opening in the panel. The insert is partially restrained initially by the portion of the panel that partially covers the insert. However, this restraint is easily overcome by additional force from the person lifting the insert. Once the initial restraint is overcome by lifting the insert, the insert will be quickly released, popping up and gaining the attention of the person lifting the insert. The insert may include a specialty item, such as an encapsulated fragrance area that is broken when the insert is opened to release a scent. Alternatively, the specialty item may be a scratch and sniff fragrance sample, a scratch-off coating hiding a message, prize or other information, or other specialty items.

In another aspect, the present invention provides a method for producing a mailing device. The method may be performed by using conventional web printing press equipment. First, a first web or ribbon of paper is conveyed along a first path while a second web or ribbon of paper is conveyed along a second path. Most preferably, the first web and the second web are ribbons formed from portions cut from a single web. The first web is folded to form an attaching panel and a free panel. Then the folded first web is aligned adjacent an inner surface of the second web. With the first web in place, the second web is first folded to form a spring panel that overlies the folded portion of the first web. A first adhesive is applied along at least a portion of the outer surface of the spring panel and a second adhesive is applied along at least a portion of the outer surface of the attaching panel that is not covered by the spring panel. Finally, the second web is folded again at an end opposite the spring panel to produce a cover panel. The cover panel overlies the portion of the attaching panel not covered by the spring panel and also covers a portion of the spring panel including the portion with the first adhesive. Thus, the cover panel is attached to the attaching panel of the first web by the second adhesive and attached to the spring panel by the first adhesive. Preferably, a third adhesive may be applied to the inner surface of the second web to secure a portion of the spring panel to a portion of the second web.

In another aspect of the above-described method, an enclosure to be included in the mailing device is formed from a third web or ribbon that is conveyed along a third path and folded a desired number of times to produce the desired enclosure. The enclosure is aligned along the inner surface of the second web and the folded first web is aligned with the enclosure such that the free panel of the first web is adjacent the enclosure. Once the enclosure and first web are aligned along the second web, the second web is folded to form the spring panel and adhesives are applied to the outer surface of the spring panel and the attaching panel prior to the cover panel being folded and attached thereto.

DETAILED DESCRIPTION

Figure 1:
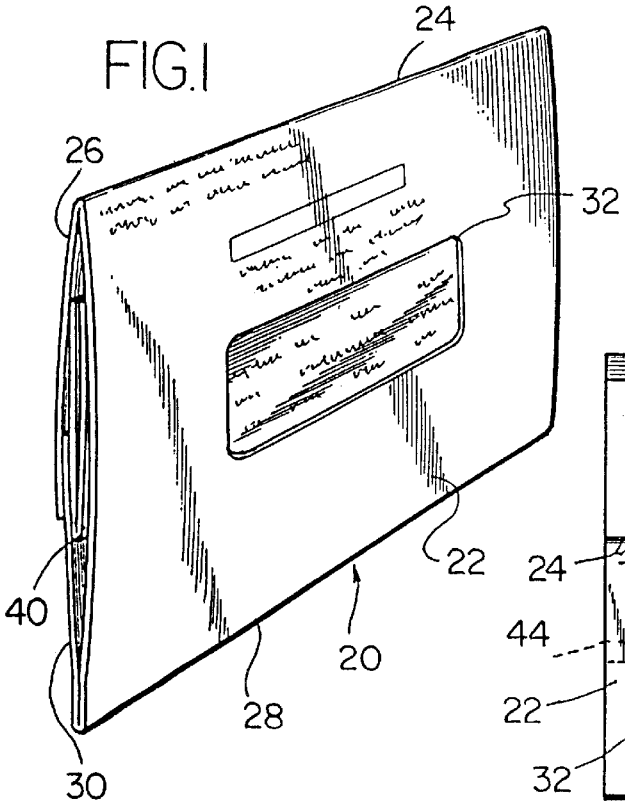
FIG. 1 is a perspective view of an advertising device in accordance with the present invention in the form of a mailing device.

Referring to the Figures generally where like numerals refer to like parts or steps, and in particular, to FIG. 1, there is illustrated an advertising device in accordance with the present invention in the form of a stand-alone mailing device 20. Mailing device 20 is one sheet formed into three panels. Front panel 22 is the address side of mailing device 20. A first fold 24 runs horizontally across the top of mailing device 20 defining a point of intersection between front panel 22 and adjoining cover panel 26. A second fold 28 runs horizontally across the bottom of mailing device 20 being substantially parallel to first fold 24. Second fold 28 separates and defines a point of intersection between front panel 22 and adjoining adjacent spring panel 30. Cover panel 26 overlays spring panel 30 forming the back of mailing device 20. As is traditional with mailing devices, mailing device 20 has sendee address portion 32 centrally located within front panel 22. In accordance with the teachings of the present invention a pop-up insert 40 is retained within mailing device 20.

Figure 2:
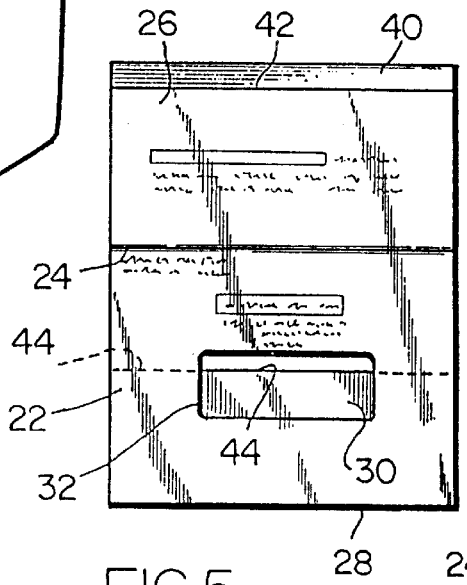
FIG. 2 is a back view of the mailing device shown in FIG. 1 in an open configuration.

FIG. 2 shows the back of mailing device 20 with cover panel 26 articulated to be substantially parallel and coplanar to front panel 22. Cover panel 26 has a free end 42 opposite first fold 24 and spring panel 30 has a free end 44, shown partially in phantom, opposite second fold 28. A portion of pop-up insert 40 is visible beyond free end 42 of cover panel 26. The sendee address portion 32 is shown in the form of a die-cut opening or window for exposing a card or enclosure (not shown) containing the sendee's address. If no card or enclosure is required, the sendee's address may be applied directly to front panel 22 in sendee address portion 32, eliminating the need for a window. Through sendee address portion 32 a portion of spring panel 30 may be seen.

Figure 3:
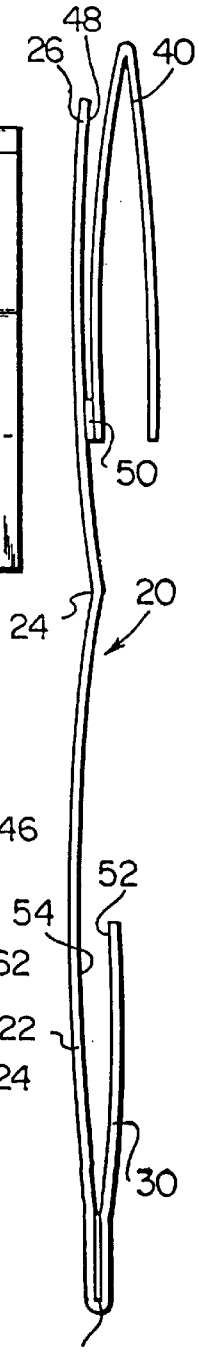
FIG. 3 is a side view of the mailing device shown in FIG. 2.

FIG. 3 is a side view of mailing device 20 with cover panel 26 articulated or unfolded. Pop-up insert 40 is adhesively attached to an inner surface 48 of cover panel 26. This attachment is preferably made by permanent glue 50. Spring panel 30 is preferably attached at its inner surface 52 to inner surface 54 of front panel 22 by permanent glue 56. The preferred permanent glue is water-based envelope or spine glue. One such envelope glue is sold under the designation WA2907PK by Elekromek Co., Inc.

Figure 4:
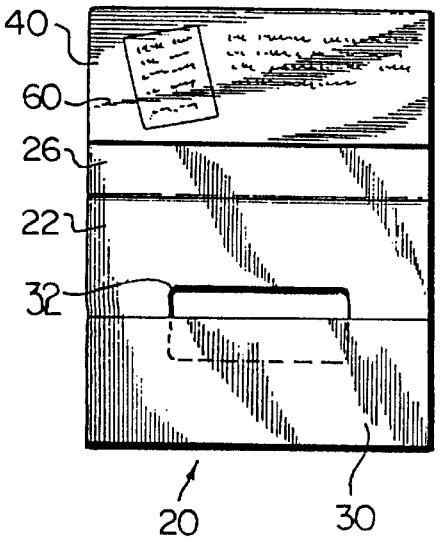
FIG. 4 is a front view of the mailing device shown in FIG. 2.
Figure 5:
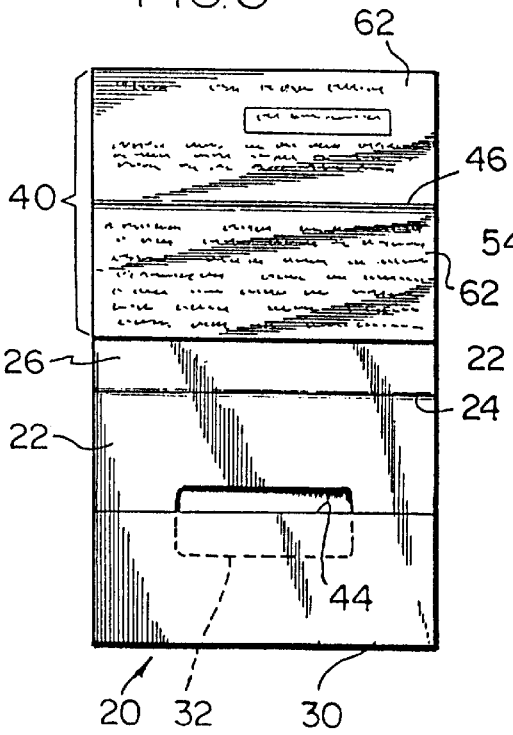
FIG. 5 is a front view of the mailing device shown in FIG. 2 with the pop-up insert in accordance with the present invention fully articulated.

FIG. 4 is a front view of mailing device 20 with cover panel 26 articulated as in FIGS. 2 and 3. A portion of outer surface 60 of pop-up insert 40 is visible and contains advertisement to catch the attention of the consumer opening mailing device 20. As shown in FIG. 5, pop-up insert 40 may be articulated around fold 46 to reveal inner surface 62 which contains additional eye catching advertisement for the consumer.

Figure 6:
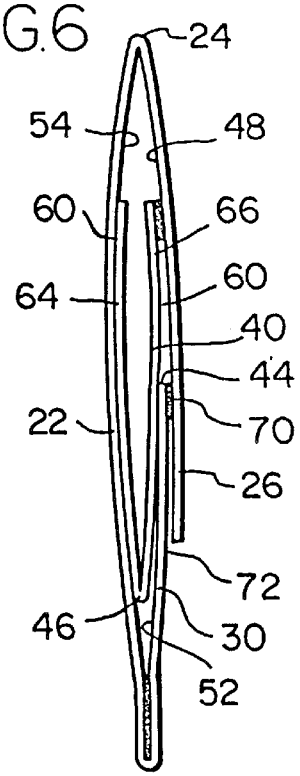
FIG. 6 is a side view of a mailing device in accordance with the present invention shown in a closed configuration.

FIG. 6 shows a side view of mailing device 20 in a closed configuration for mailing. In the closed configuration, a portion of inner surface 52 of spring panel 30 overlays and restrains pop-up insert 40. Fold 46 divides pop-up insert 40 into a free panel 64 and an attaching panel 66. The outer surface 60 of attaching panel 66 lays adjacent to inner surface 52 of spring panel 30. Outer surface 60 of free panel 64 is adjacent to inner surface 54 of front panel 22. Fugitive glue 70 is used to releasably secure cover panel 26 to outer surface 72 of spring panel 30. Fugitive glue 70 sufficiently secures cover panel 26 to spring panel 30 to prevent inadvertent opening during transit or mailing, but allows cover 26 to be released from spring panel 30 with a small amount of force from a consumer without tearing or otherwise damaging device 20. Fugitive glue 70 is applied near free end 44 of spring panel 30. The preferred fugitive glue is water-based fugitive glue. One such fugitive glue is sold under the designation Craigbond #3991 PLV by Craig Adhesives & Coatings Co.

Figure 7:
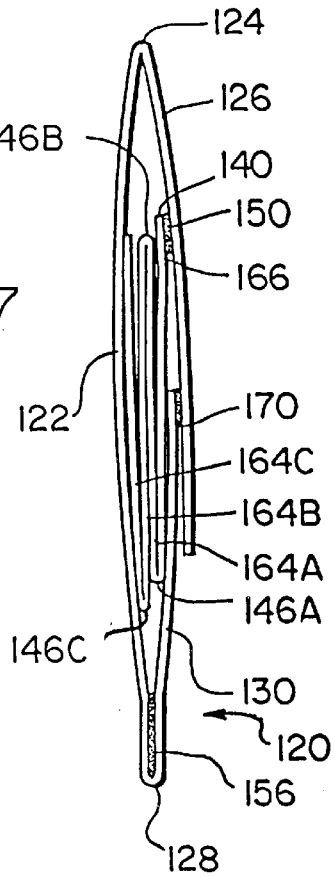
FIG. 7 is a side view of an alternative embodiment of a mailing device in accordance with the present invention.

FIG. 7 is an alternative preferred embodiment of an advertising device in accordance with the principles of the present invention in the form of a mailing device 120, shown in a side view. Mailing device 120 has three panels formed from a single sheet. Front panel 122 serves as the address side of mailing device 120. Fold 124 extends horizontally along the top of device 120 where front panel 122 adjoins cover panel 126. A second fold 128 extends horizontally along the bottom of device 120 substantially parallel to fold 124 between front panel 122 and adjoining spring panel 130. Preferably, spring panel 130 is adhesively secured to front panel 122 by permanent glue 156 near fold 128. In the closed configuration, as shown in FIG. 7, cover panel 126 is releasably secured to an outer surface of spring panel 130 by fugitive glue 170. A pop-up insert 140 is retained within mailing device 120. Pop-up insert 140 has a plurality of panels defined by folds 146A–C. Attaching panel 166 is attached to the inner surface of cover 126 by permanent glue 150. The remaining panels 164A–C of pop-up insert 140 are not attached to device 120. Notably, similar to the embodiment shown in FIG. 6, spring panel 130 overlays an outer surface of attaching panel 166 to retain pop-up insert 140 within mailing device 120 even when cover panel 126 is first articulated. The inner surface of cover 126 is releasably secured to the outer surface of spring panel 130 near a free end of spring panel 130 and a free end of cover panel 126. Preferably, fold 146C extends deeper into device 120 than fold 146A, which is adjacent fold 146C and closer to cover panel 126.

Figure 9:
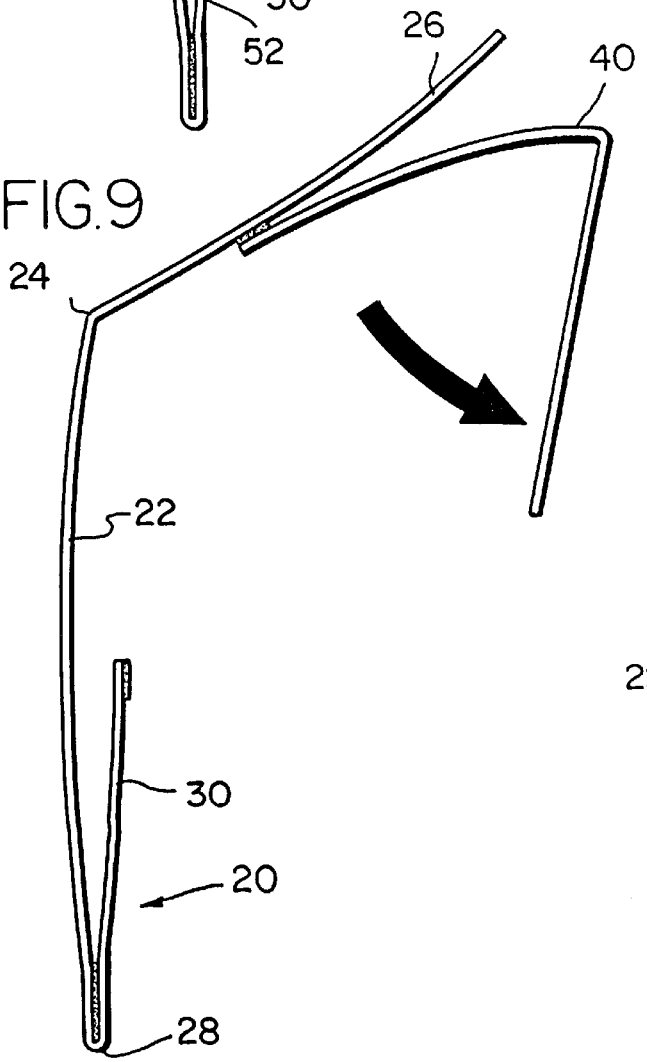
FIG. 9 is a side view of a mailing device in accordance with the present invention in an open configuration.
Figure 8:
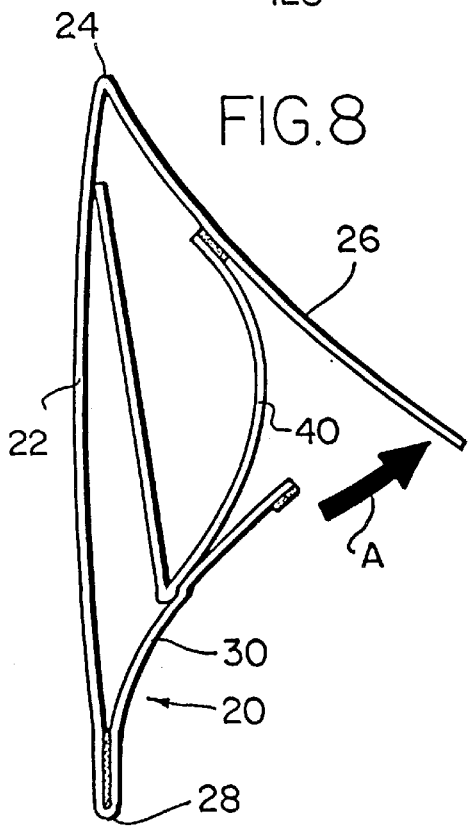
FIG. 8 is a side view of a mailing device in accordance with the present invention in a partially open configuration.

The operation of mailing device 20 is best described with reference to FIGS. 6, 8 and 9 which are side views that show progressively the mailing device 20 going from the closed configuration to an open configuration. As previously described, FIG. 6 shows mailing device 20 in a closed configuration with cover panel 26 releasably secured to spring panel 30 and pop-up insert 40 retained by spring panel 30. In normal operation, a consumer receiving mailing device 20 will secure the bottom portion of mailing device 20 near fold 28 in his hand by placing his thumb over a bottom portion of spring panel 30. In accordance with the normal procedures for opening an envelope and preferably, also in accordance with written instructions on cover panel 26, the consumer will lift cover panel 26 at the free end to release the fugitive glue bond between the inner surface of cover panel 26 and the outer surface of spring panel 30. After releasing cover panel 26 from spring panel 30 by moving panel 26 generally in the direction of arrow A, the mailing device 20 will attain a configuration similar to that shown in FIG. 8. Notably, pop-up insert 40 is retained within mailing device 20 by spring panel 30. Additionally, the consumer's thumb may also help to retain insert 40 within device 20. The force of moving cover panel 26 will cause energy to be stored in the spring mechanism comprising spring panel 30 and insert 40. When the consumer supplies sufficient force to overcome the restraint provided by spring panel 30, pop-up insert 40 will accelerate briskly from within the confines of device 20 drawing the attention of the consumer and also producing a rustling sound due to the brisk movement of the paper. This will cause mailing device 20 to attain a configuration substantially as shown in FIG. 9. The device 20 may then be articulated as shown in FIGS. 4 and 5. The pop-up effect may be adjusted by varying the weight of the paper, the amount of overlap between the insert and the spring panel and the application of glue between the spring panel and front panel.

Mailing device 120 operates in a manner similar to mailing device 20 with variations in effect caused by the plurality of free panels 164A–C. Most preferably, where fold 146C extends deeper into device 120 than fold 146A, which is adjacent cover panel 126, the pop-up effect will be repeated when fold 146C is released from within device 120. Additional folds in pop-up insert 140, each fold extending deeper than the adjacent fold, may be added to multiply the pop-up effect.

In a preferred embodiment, an advertisement device in accordance with the principles of the present invention in the form of a mailing device will also include an enclosure as illustrated in FIGS. 10 through 14. The enclosure may carry valuable information for a consumer and preferably may include a business reply envelope and an order form.

Figure 10:
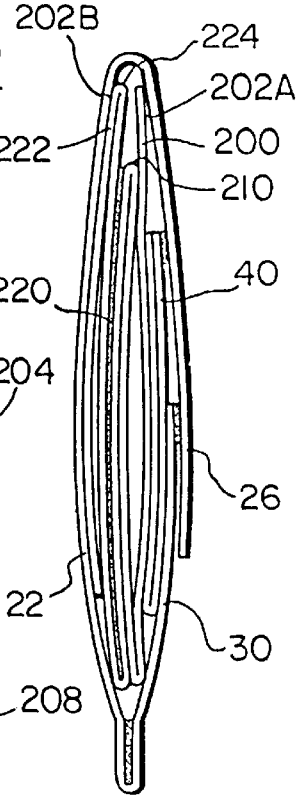
FIG. 10 is an embodiment of a mailing device in accordance with the present invention including an enclosure.

FIG. 10 shows a side view of mailing device 20 with an enclosure 200 retained within the device. Enclosure 200 is preferably one contiguous form or sheet with a plurality of panels, one or more of which may be formed into an envelope. Enclosure 200 may simply rest within mailing device 20 between pop-up insert 40 and the inner surface of front panel 22. Preferably, enclosure 200 is releasably secured within mailing device 20 by fugitive glue in area 202A or optionally in area 202B. Generally, enclosure 200 will be secured either to cover panel 26 in area 202A or front panel 22 in area 202B but not to both. Notably, securing enclosure 200 to cover panel 26 will vary the pop-up effect of the mailing device since in addition to pop-up insert 40, enclosure 200 may also be released when cover panel 26 is fully articulated.

Figure 11:
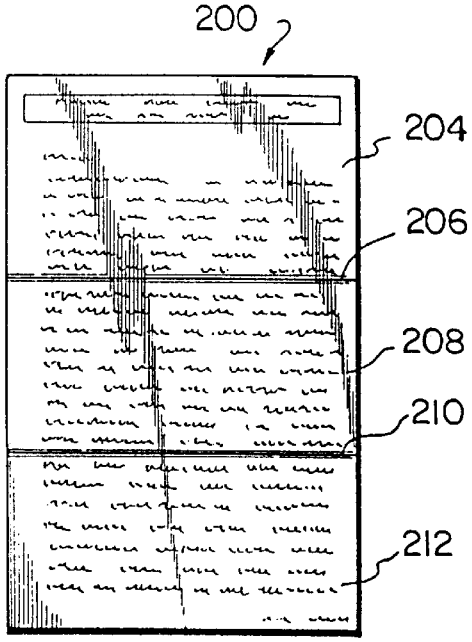
FIG. 11 is a front view of the enclosure shown in FIG. 10.
Figure 12:
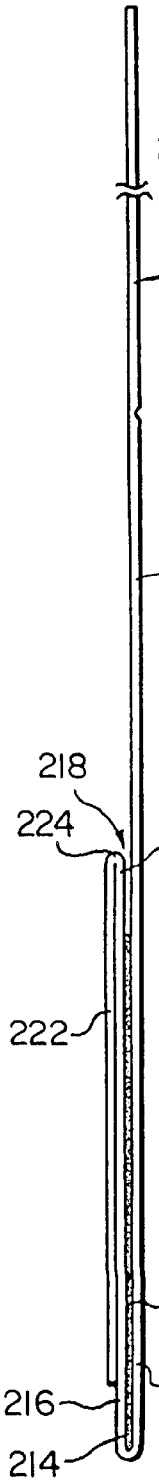
FIG. 12 is a side view of the enclosure shown in FIG. 10.
Figure 13:
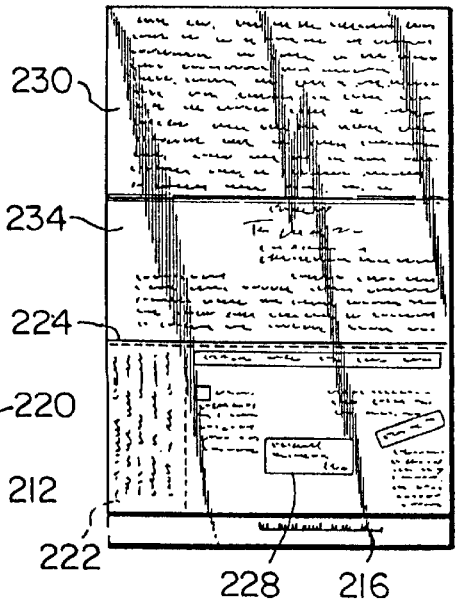
FIG. 13 is a back view of the enclosure shown in FIG. 10.
Figure 14:
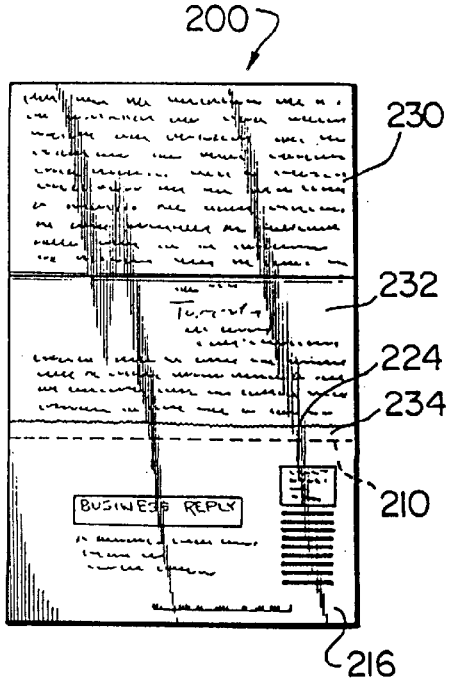
FIG. 14 is a back view of the enclosure shown in FIG. 10 with a slight modification to the enclosure.

FIGS. 11, 12 and 13 show respectively, a front view, a side view and a back view of enclosure 200 with its plurality of panels fully articulated to be parallel to each other. When fully articulated or unfolded, the front of enclosure 200 reveals a top panel 204, a middle panel 208 and a bottom panel 212. Top panel 204 and middle panel 208 are adjoined and adjacent, being separated by fold 206. Middle panel 208 and bottom panel 212 are adjacent and adjoined and separated by fold 210 which is also perforated. Top panel 204 preferably includes the greeting to the consumer and is followed by valuable printed matter contiguously to the end of bottom panel 212. As best seen in FIG. 12, panel 212 is the back of an envelope 214. The front address portion of envelope 214 is formed by panel 216. Panel 212 and panel 216 are adhesively secured together around two of their edges by permanent glue 220, leaving an opening 218 for accessing the content of envelope 214. Preferably panel 222 is an order form for the consumer to return a reply to the advertiser. Most preferably, panel 222 is easily detached from enclosure 200 by perforations along fold 224. As best seen in FIG. 13, panel 222 has an addressee portion 228, which preferably aligns with die-cut window 32 in mailing device 20, as shown in FIGS. 1–5. A distinct advantage of the present invention is the alignment of the addressee portion 228 with die-cut window 32, allowing imaging of the address information. Additionally, since the sendee's address is imaged on the order form, the consumer need not rewrite it when ordering. The reuse of the sendee's address reduces the possibility of mistake or omission because only one address is used for both sending and a subsequent reply. Panels 230 and 232, which are the backs of panels 204 and 208, respectively, may continue the message to the consumer preferably ending at panel 232. FIG. 14 is a back view of enclosure 200 similar to FIG. 13, except that the order form, panel 222, has been removed, revealing the front of envelope 214. Envelope 214 may preferably be detached from enclosure 200 by the perforations along fold 210. A flap 234 for closing envelope 214 is found intermediate panel 216 and the perforations along fold 224. Preferably flap 234 has a water-based remoistenable adhesive that may be activated by the consumer by applying moisture, such as the type of adhesive commonly used on conventional envelopes. One such water-based remoistenable adhesive is sold under the designation Craigbond #3198A by Craig Adhesives & Coatings Co.

Where no order form is necessary, enclosure 200 may be formed without panel 222, as is reflected in FIG. 14. In this alternative embodiment, enclosure 200 is preferably placed within mailing device 20 such that panel 204 is adjacent front panel 22 and die-cut window 32 is aligned with the sendee's address as printed on panel 204.

Figures 15, 16, 17A:
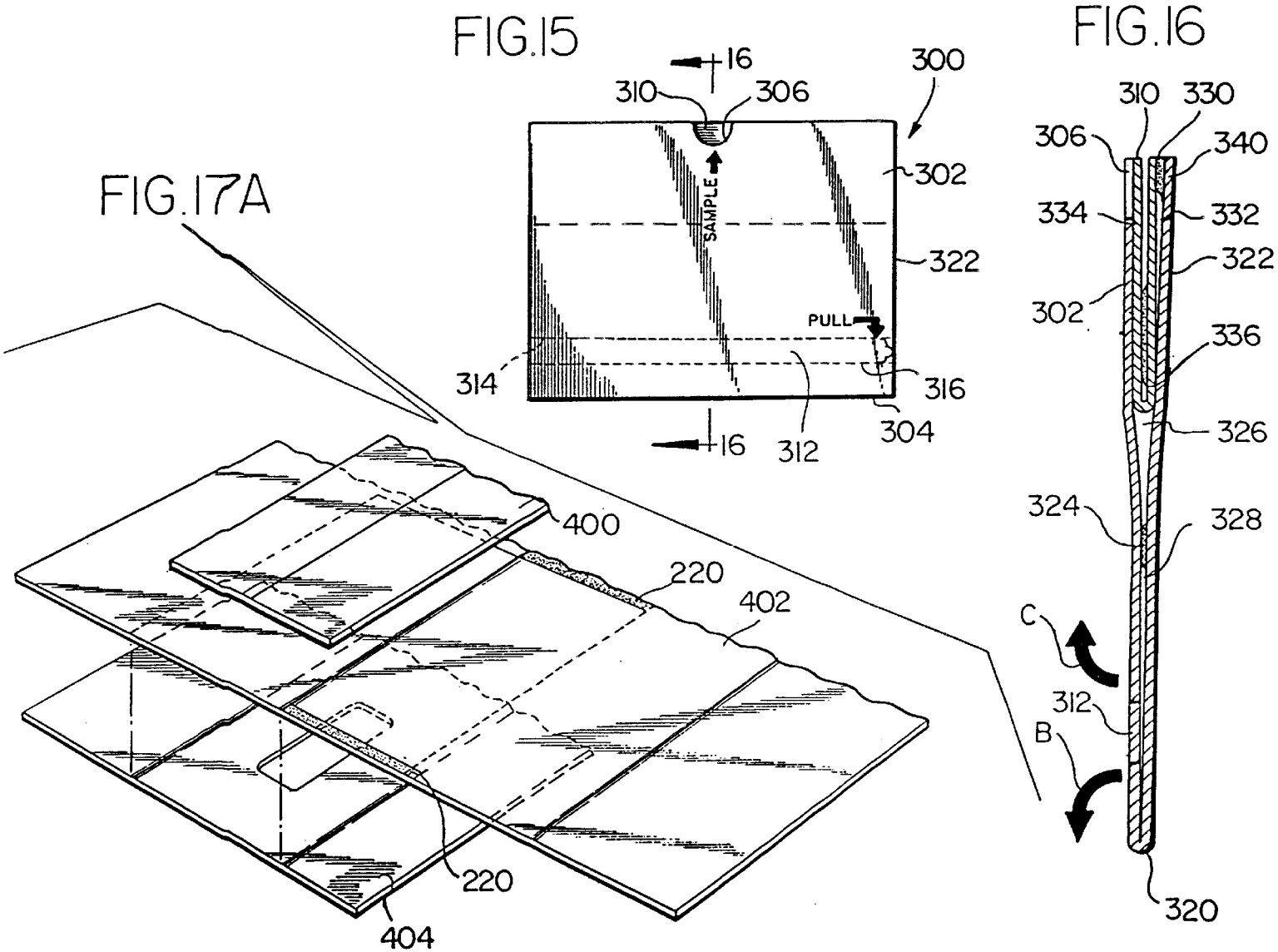
FIG. 15 is a front view of an advertising device in accordance with the present invention in the form of a magazine insert.
FIG. 16 is a cross sectional view of the magazine insert shown in FIG. 15 taken along line 16—16.
FIGS. 17A–I are perspective views illustrating a method of producing an advertising device in accordance with the principles of the present invention.

FIG. 15 shows an advertising device in accordance with the principles of the present invention in the form of a magazine insert 300. Magazine insert 300 appears as a normal page in a magazine bound along side 304. An opening or thumb notch 306 is formed within the magazine insert 300. The opening 306 may be used by the consumer to gain access to pop-up insert 310. The consumer's attention may be directed to opening 306 by conspicuous words on the page such as "sample." Retained below opening 306 is pop-up insert 310 in accordance with the principles of the present invention. Preferably, magazine insert 300 may also include a zip strip 312 that may be removed by the consumer. Zip strip 312 is formed by two parallel lines of perforations 314, 316. Magazine insert 300 may have perforations (not shown) adjacent side 304 for removing insert 300.

FIG. 16 is a cross sectional view of magazine insert 300 taken along lines 16—16 in FIG. 15. Bottom panel 322 of insert 300 is adjoined to panel 302 by fold 320 and by adhesion with permeanent glue 324 at a center portion of panels 302 and 322. Bottom panel 322 has an opening or thumb notch (not shown), similar to panel 302. Glue 324 effectively divides insert 300 into two compartments, a first compartment 326 containing pop-up insert 310 and a second compartment 328. Compartment 328 is accessible by removing zip strip 312 and articulating the portions of panel 302 as shown by arrows B and C. Preferably compartment 328 may hold items of interest to the consumer, such as coupons or game/sweepstakes tickets that may be unique per insert. Pop-up insert 310 is retained in compartment 326 by glue 324, glue 330 and the spring action from panel 302. A line of perforations 332 are provided so that pop-up insert 310 may be removed from compartment 326 and retained by a consumer. Most preferably, a specialty item 336 is maintained within pop-up insert 310. Specialty item 336 may be a fragrance sample or other specialty item that is made available when the top flap 334 of pop-up insert 310 is pulled from opening 306.

In operation, a consumer is directed by the insert to pull top flap 334 of pop-up insert 310 to gain access to a sample. Initially pop up insert 310 is retained within magazine insert 300 by panel 302. However, the consumer may eventually supply enough force to overcome the retaining means and will force pop-up insert 310 to escape from between panels 302 and 322 gaining the attention of the consumer and also freeing access to the specialty item 336. Where specialty item 336 is a fragrance sample, the force applied by the consumer in removing pop-up insert 310 will break the coating on the encapsulated sample allowing the essential oil to emit its scent. Additional force on pop-up insert 310 will facilitate its removal from within insert 300 by detaching portion 340 of bottom panel 322 at perforations 332. Insert 310 may be retained by the consumer for additional uses, such as the use of additional fragrance samples that may be contained within the insert but not released by its removal. Additionally, the consumer may pull zip strip 312 to gain access to compartment 328 which may contain other specialty items, such as coupons or sweepstakes tickets which may be unique for a particular insert 300.

Mailing devices 20, 120, shown in FIGS. 1–10, may be adapted to be magazine inserts. For example, folds 28, 128, may be bound into a magazine spine. A line of perforations running adjacent and parallel to folds 28, 128 on spring panels 30, 130 and front panels 22, 122 may be provided to make devices 20, 120 detachable.

FIGS. 17A–I illustrate a method by which an advertising device in the form of a mailing device or magazine insert may be constructed in accordance with the principles of the present invention. In particular, FIGS. 17A–I illustrate a method by which device 20, including insert 200, as shown in FIG. 10, may be constructed. While a wide variety of finishing equipment may be used to produce the advertising devices, the preferred equipment consists of an appropriate number of plowfolding stations, multiple glue application systems, die cutter, a rotary cutter and a delivery system.

FIG. 17A shows three separate ribbons, top ribbon 400, middle ribbon 402 and bottom ribbon 404, vertically aligned with each other. Preferably, top ribbon 400, middle ribbon 402 and bottom ribbon 404 are initially a part of a single web of paper that is cut to form the three ribbons prior to the ribbons being vertically aligned. However, ribbons 400, 402 and 404 may be considered separate webs. The ribbons are printed and contain any necessary perforations or remoistenable adhesives, such as the remoistenable adhesive for a reply envelope. Top ribbon 400 will eventually form pop-up insert 40. Middle ribbon 402 will be formed into enclosure 200. Bottom ribbon 404 will wrap around top ribbon 400 and middle ribbon 402 forming the cover panel 26, front panel 22 and spring panel 30 of mailing device 20.

Figures 17B, 17C, 17D:
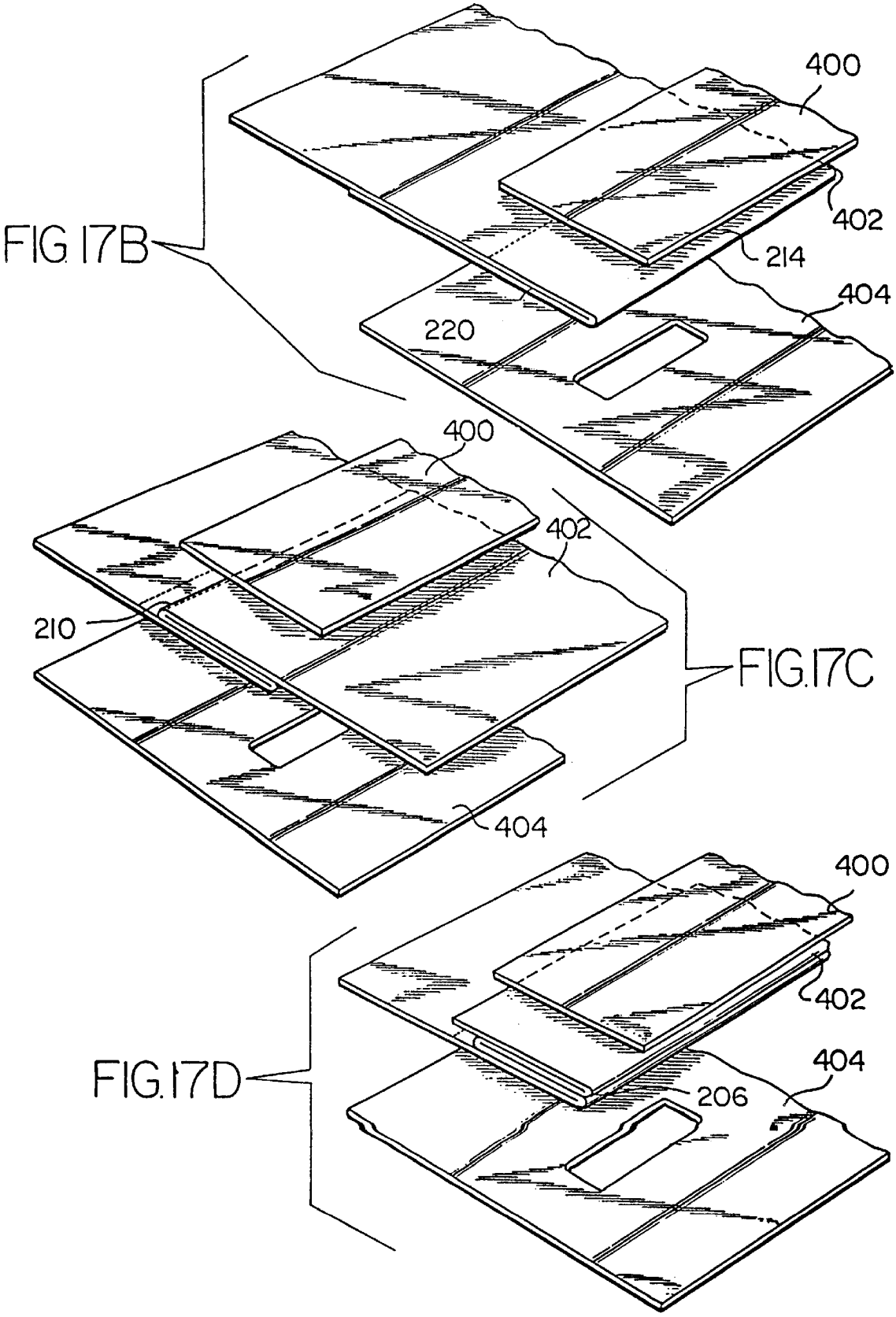
Figure 17E:
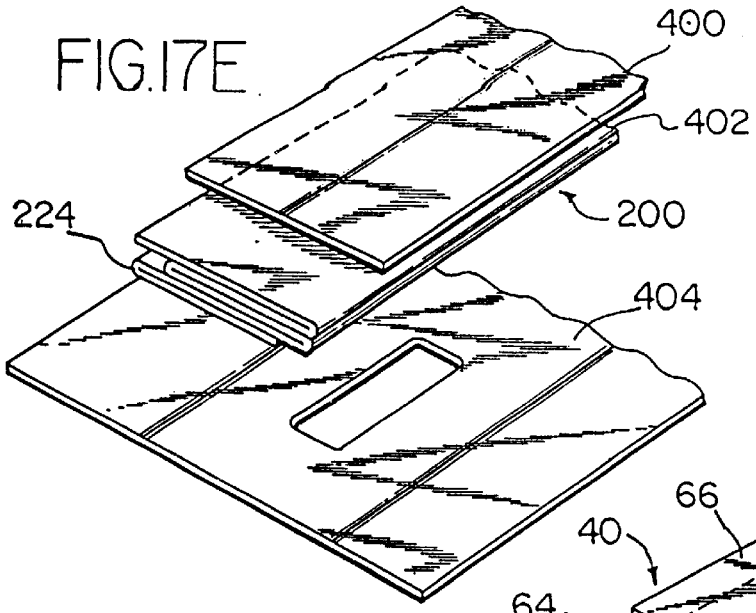

Preferably, enclosure 200 is first formed by manipulating middle ribbon 402 as shown in FIGS. 17B–E. As shown in FIGS. 17A&B, adhesive or glue 220 is applied along the desired points of middle ribbon 402 for sealing the sides of envelope 214. This adhesive is preferably a water-based envelope or spine glue. The fold formed in FIG. 17B serves as the bottom of envelope 214. Middle ribbon 402 is then folded in an opposite direction as shown in FIG. 17C. The fold produced corresponds to fold 210, which is perforated. Fold 206 and fold 224 are formed in FIGS. 17D and 17E, respectively, completing the formation of enclosure 200.

Figure 17F:
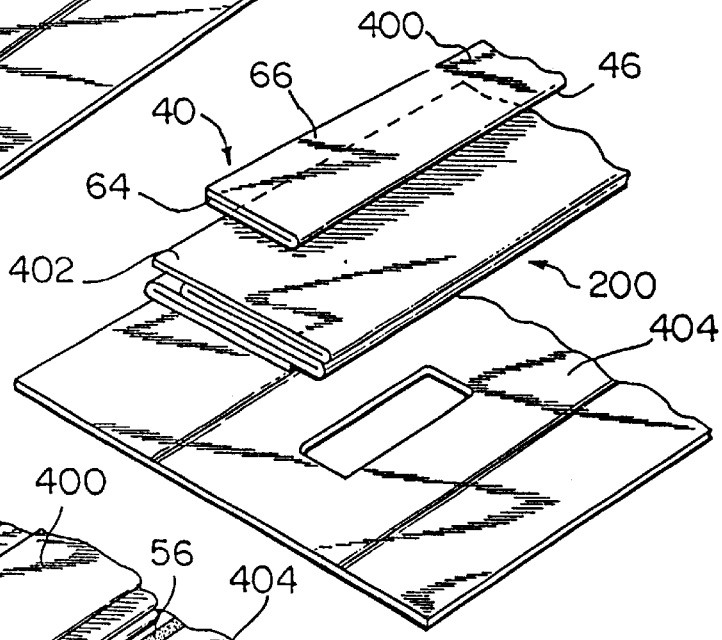
Figure 17G:
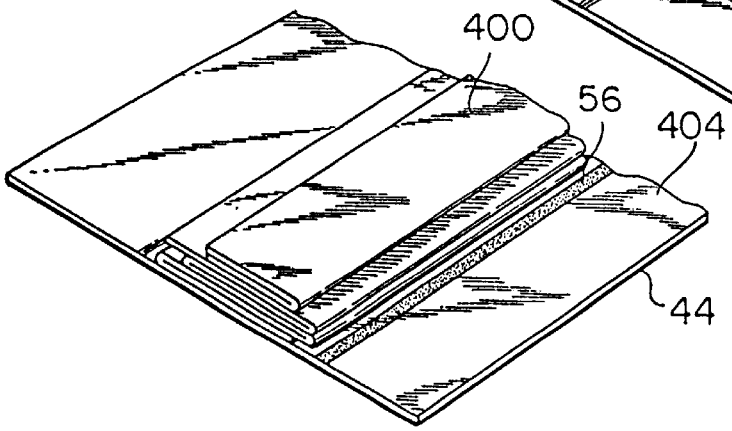
Figure 17H:
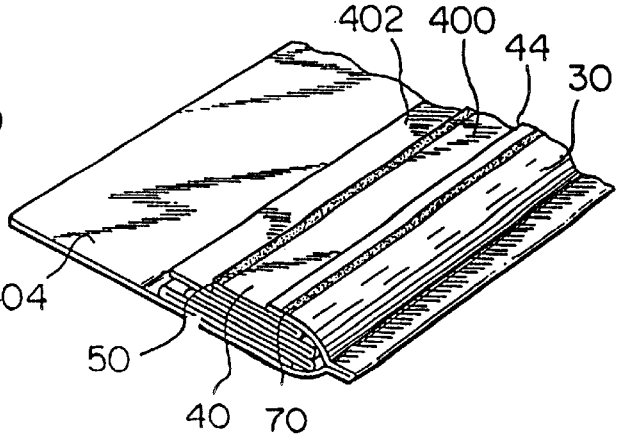
Figure 17I:
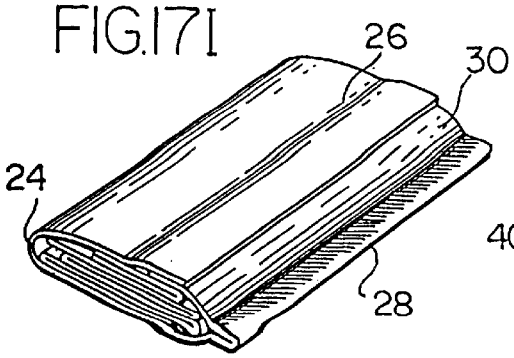

FIG. 17F illustrates how top ribbon 400 is folded to form pop-up insert 40. Fold 46 divides the portion of top ribbon 400 that will become attaching panel 66 from the portion of top ribbon 400 that becomes free panel 64. Before bottom ribbon 404 is folded, folded top ribbon 400 and folded middle ribbon 402 are aligned to overlay each other and bottom ribbon 404, as shown in FIG. 17G. Adhesive 56 is applied along bottom ribbon 404 as shown in FIG. 17G in an area that will be folded as shown in FIG. 17H. Fold 28 is then formed by wrapping a free end 44 around middle ribbon 402 and top ribbon 400 as shown in FIG. 17H. Then adhesive 50 and adhesive 70 are applied, respectively, to the attaching panel 66 of pop-up insert portion 40 and a portion of spring panel 30. Finally, fold 24 is produced by wrapping the end of bottom ribbon 404 around enclosure 200 and pop-up insert 40 onto spring panel 30. Cover panel 26 is adhesively secured by adhesive 50 and adhesive 70. Alternatively, adhesive 50 and adhesive 70 may be applied to cover panel 26 in the areas to be attached to pop-up insert 40 and spring panel 30 prior to folding. The webs may then be cut to size as illustrated in FIG. 17I.

In a preferred embodiment of mailing device 20, mailing device 20 in a closed configuration is approximately 5 inches (")×7"; ribbons 400, 402, 404 are respectively, approximately 5½", 18½" and 11__" wide; cover panel 26, front panel 22, and spring panel 30 are respectively, approximately, 3__"×7", 5"×7", and 2¾"×7"; attaching panel 66 and free panel 64 are approximately 2¾"×7"; panels 216 and 204 of enclosure 200 are approximately 4"×7"; and panels 222, 212 and 208 of enclosure 200 are approximately 3½"×7".

Alternative embodiments of the above-described method may be produced by altering or eliminating enclosure 200. Mailing device 20, as shown in FIG. 6 without enclosure 200 may be produced by completing the folding and adhesion steps in FIGS. 17F–I, of course without enclosure 200.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A method of producing an advertisement device comprising the steps of:

conveying a first ribbon along a first path;

conveying a second ribbon along a second path;

folding the first ribbon to form an attaching panel and a free panel;

aligning the folded first ribbon such that the free panel is adjacent an inner surface of the second ribbon;

folding the second ribbon to form a spring panel that overlies a portion of the attaching panel of the first ribbon;

applying a first adhesive along a portion of the spring panel;

applying a second adhesive along a portion of the attaching panel; and folding the second ribbon to produce a cover panel that overlies and attaches to the first adhesive on the spring panel and the second adhesive on the attaching panel, to form a pop-up device.

2. The method of claim 1 further comprising the step of applying a third adhesive to an inner surface of the second ribbon prior to folding the second ribbon to form a spring panel, the third adhesive securing a portion of the spring panel to a portion of the inner surface of the second ribbon.

3. The method of claim 1 further comprising the steps of:

conveying a third ribbon along a third path;

folding the third ribbon into an enclosure;

aligning the enclosure adjacent the inner surface of the second ribbon and the free panel of the first ribbon prior to folding the second ribbon to form a spring panel.

4. The method of claim 1 wherein the first adhesive is a water-based fugitive glue.

5. The method of claim 1 wherein the second adhesive is a water-based envelope glue.

6. The method of claim 3 further comprising the step of:

prior to aligning the enclosure adjacent the inner surface of the second ribbon, applying a fourth adhesive to a portion of the inner surface of the second ribbon that will be in contact with the enclosure when the enclosure is aligned with the inner surface of the second ribbon.

7. The method of claim 6 wherein the fourth adhesive is a water-based fugitive glue.

8. The method of claim 3 further comprising the step of:

prior to folding the second ribbon to produce the cover panel, applying a fifth adhesive to a portion of the enclosure that will be in contact with the cover panel when the cover panel is folded.

9. The method of claim 8 wherein the fifth adhesive is a water-based fugitive glue.

* * * * *

UNITED STATES PATENT AND TRADEMARK OFFICE

CERTIFICATE OF CORRECTION

PATENT NO. : 6,036,806
DATED : March 14, 2000
INVENTOR(S) : Ake L. Dahlquist

It is certified that error appears in the above-identified patent and that said Letters Patent is hereby corrected as shown below:

Column 7,
Line 30, delete "permeanent" and insert therefor -- permanent --.
Line 51, delete "pop up" and insert therefor -- pop-up --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*